US010179455B2

(12) United States Patent
Keefe et al.

(10) Patent No.: US 10,179,455 B2
(45) **Date of Patent: *Jan. 15, 2019**

(54) DUAL REGULATOR PRINT MODULE

(71) Applicant: HEWLETT-PACKARD DEVELOPMENT COMPANY, L.P., Houston, TX (US)

(72) Inventors: Brian J. Keefe, La Jolla, CA (US); Joseph E. Scheffelin, Poway, CA (US); James W. Ring, Blodgett, OR (US); Mark A. Devries, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/652,531

(22) Filed: Jul. 18, 2017

(65) Prior Publication Data

US 2017/0313088 A1 Nov. 2, 2017

Related U.S. Application Data

(62) Division of application No. 13/819,902, filed as application No. PCT/US2010/053133 on Oct. 19, 2010, now Pat. No. 9,724,926.

(51) Int. Cl.
*B41J 2/18* (2006.01)
*B41J 2/17* (2006.01)
(Continued)

(52) U.S. Cl.
CPC ..... *B41J 2/17* (2013.01); *B41J 2/175* (2013.01); *B41J 2/17563* (2013.01);
(Continued)

(58) Field of Classification Search
CPC ..... B41J 2/18
See application file for complete search history.

(56) References Cited

U.S. PATENT DOCUMENTS 4,403,229 A 9/1983 Barteck
5,565,900 A 10/1996 Cowger
(Continued)

FOREIGN PATENT DOCUMENTS

CN 101412322 4/2009
EP 2050572 A2 4/2009
(Continued)

OTHER PUBLICATIONS

CN Office Action dated Jul. 21, 2014, CN Patent Application No. 201080069724.1 dated Oct. 19, 2010, The State Intellectual Property Office, P.R. China.

(Continued)

*Primary Examiner* — Julian D Huffman
(74) *Attorney, Agent, or Firm* — HP Inc.—Patent Department

(57) ABSTRACT

A print module includes a printhead die, an input regulator to regulate input fluid pressure to the die, and an output regulator to regulate output fluid pressure from the die. A method includes receiving fluid at an input regulator to a print module, creating a fluid pressure differential within the print module between the input regulator and an output regulator, flowing fluid from the input regulator through a printhead die and to an output regulator using the pressure differential, and drawing fluid from the output regulator.

19 Claims, 8 Drawing Sheets

(51) Int. Cl.
*B41J 2/175* (2006.01)
*B41J 29/38* (2006.01)

(52) U.S. Cl.
CPC ..... *B41J 2/17596* (2013.01); *B41J 2/18* (2013.01); *B41J 29/38* (2013.01)

(56) References Cited

U.S. PATENT DOCUMENTS

| | | | | |
|---|---|---|---|---|
| 6,030,074 | A | 2/2000 | Barinaga | |
| 6,116,727 | A | 9/2000 | Hagiwara | |
| 6,428,156 | B1 | 8/2002 | Waller | |
| 6,464,346 | B2 | 10/2002 | Otis, Jr. et al. | |
| 6,652,080 | B2 | 11/2003 | Childs et al. | |
| 9,724,926 | B2 * | 8/2017 | Keefe | B41J 2/17 |
| 2002/0080216 | A1 | 6/2002 | Dowell et al. | |
| 2007/0182792 | A1 | 8/2007 | Akahane | |
| 2008/0055378 | A1 | 3/2008 | Drury et al. | |
| 2009/0091606 | A1 | 4/2009 | Haines et al. | |
| 2009/0219323 | A1 * | 9/2009 | Silverbrook | B41J 2/175 347/17 |
| 2009/0244226 | A1 | 10/2009 | Hoshino | |
| 2009/0267976 | A1 | 10/2009 | Lee | |
| 2010/0073444 | A1 | 3/2010 | Daisuke | |
| 2010/0085396 | A1 | 4/2010 | Yokota | |
| 2010/0201742 | A1 | 8/2010 | Karppinen et al. | |

FOREIGN PATENT DOCUMENTS

| | | |
|---|---|---|
| JP | 2005342960 | 12/2005 |
| JP | 2006-088564 | 4/2006 |
| JP | 2009023289 A | 2/2009 |
| JP | 2009-233972 | 10/2009 |
| JP | 2010-083021 | 4/2010 |
| JP | 2011-110853 | 6/2011 |
| WO | WO-2009/142889 | 11/2009 |

OTHER PUBLICATIONS

U.S. Office Action dated Jul. 11, 2014, U.S. Appl. No. 13/819,902 dated Oct. 19, 2010, United States Patent and Trademark Office.

* cited by examiner

DUAL REGULATOR PRINT MODULE

BACKGROUND

Inkjet printing devices generally provide high-quality image printing solutions at reasonable cost. Inkjet printing devices print images by ejecting ink drops through a plurality of nozzles onto a print medium, such as a sheet of paper. Nozzles are typically arranged in one or more arrays, such that properly sequenced ejection of ink from the nozzles causes characters or other images to be printed on the print medium as the printhead and the print medium move relative to each other. In a specific example, a thermal inkjet (TIJ) printhead ejects drops from a nozzle by passing electrical current through a heating element to generate heat and vaporize a small portion of the fluid within a firing chamber. In another example, a piezoelectric inkjet (PIJ) printhead uses a piezoelectric material actuator to generate pressure pulses that force ink drops out of a nozzle.

Improving the image print quality from inkjet printing devices typically involves addressing one or more of several technical challenges that can reduce image print quality. For example, pigment settling, air accumulation, temperature variation and particle accumulation within printhead modules can contribute to reduced print quality and eventual printhead module failure. One method of addressing these challenges has been to recirculate ink within the ink delivery system and print modules. However, the cost and size of macro-recirculation systems designed for this purpose are typically only appropriate for high-end industrial printing systems. In addition, product architectures that attempt to address the cost issue with less complexity typically become associated with poor performance and reliability.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

Figure 1:
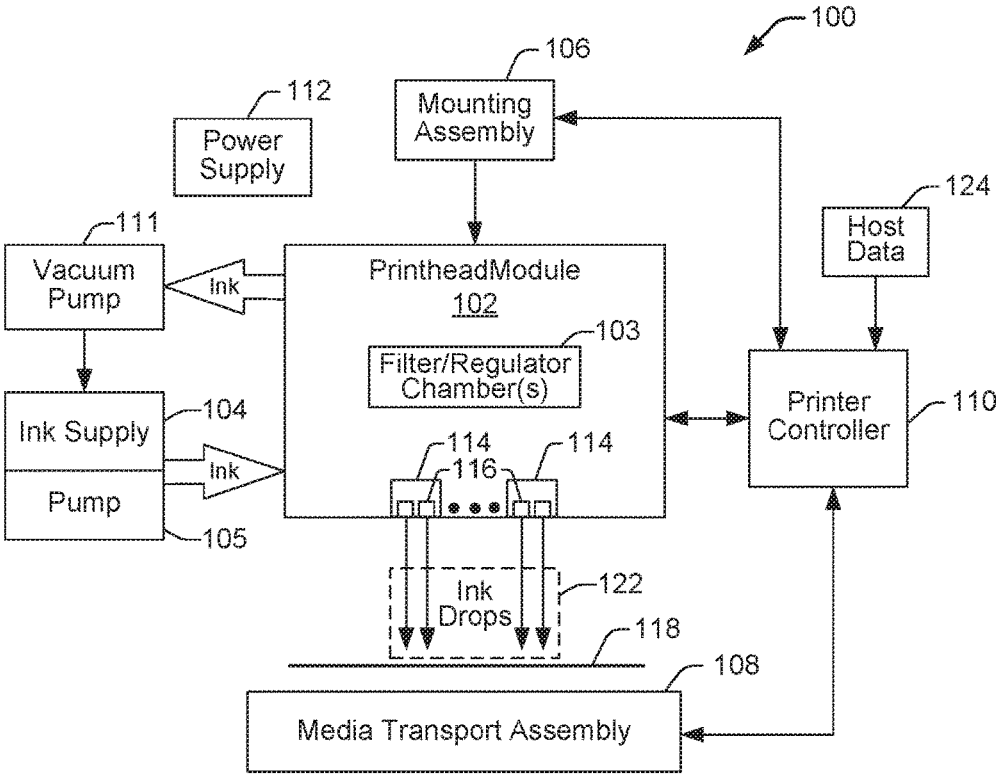
FIG. 1 shows an inkjet printing system suitable for incorporating a macro-recirculation system and dual regulator printhead module, according to an embodiment.

As noted above, there are a number of challenges associated with image print quality in inkjet printing devices. Print quality suffers, for example, when there is ink blockage and/or clogging in inkjet printheads, temperature variations across the printhead die, and so on. Causes for these difficulties include pigment settling, accumulations of air and particulates in the printhead, and inadequate control of temperature across the printhead die. Pigment settling, which can block ink flow and clog nozzles occurs when pigment particles settle or crash out of the ink vehicle (e.g., solvent) during periods of storage or non-use of a printhead module (a printhead module includes one or more printheads). Pigment-based inks are generally preferred in inkjet printing as they tend to be more efficient, durable and permanent than dye-based inks, and ink development in commercial and industrial applications continues in the direction of higher pigment or binder loading and larger particle size. Air accumulation in printheads causes air bubbles that can also block the flow of ink. When ink is exposed to air, such as during storage in an ink reservoir, additional air dissolves into the ink. The subsequent action of ejecting ink drops from the firing chamber of the printhead releases excess air from the ink which accumulates as air bubbles that can block ink flow. Particle accumulation in printheads can also obstruct the flow of ink. Contamination during manufacturing and shedding of particles from injection-molded plastic parts during operation can result in particle accumulation. Although printhead modules and ink delivery systems typically include filters, particle accumulation in printheads can reach levels that eventually block printhead nozzles, causing print quality issues and print module failure. Thermal differences across the surface of the printhead die, especially along the nozzle column, influence characteristics of ink drops ejected from nozzles, such as the drop weight, velocity and shape. For example, a higher die temperature results in a higher drop weight and drop velocity, while a lower die temperature results in a lower drop weight and velocity. Variations in the drop characteristics adversely impact print quality. Therefore, controlling temperature in printhead modules is an important factor in achieving higher print quality, especially as nozzle packing densities and firing repetition rates continue to increase. Macro-recirculation of ink through the printhead module ("printhead module", "print module", "printer module", and the like, are used interchangeably throughout this document) addresses these problems and is an important component in competitive inkjet systems, but it has yet to be incorporated into an approach that supports low-cost products with minimal system requirements on printer ink delivery systems.

Common inkjet printing systems that feature macro-recirculation of ink enable this function through sophisticated off-module control systems (i.e., control systems that are not onboard the printhead module itself) that incorporate electromechanical functions together with pumps, regulators, and accumulators. Various features are included such as out-of-ink detection, heat exchangers, filtration systems, and pressure sensors for controlled feedback. The high system overhead for these functions is commonly considered appropriate given the high cost of PIJ printheads, which are often permanently installed and infrequently replaced. However, the cost and size of these systems is only appropriate for high-end industrial systems, and product architectures that attempt to address the cost issue with less complexity typically become associated with poor performance and reliability. Moreover, printhead modules that do not have onboard pressure control systems suffer from sensitivity during installation and must utilize extensive priming operations to achieve a robust level of image and print quality.

Embodiments of the present disclosure overcome disadvantages of prior macro-recirculation systems generally by using dual pressure regulators incorporated onboard a thermal or piezo inkjet (i.e., TIJ or PIJ) printhead module. Dual regulators control pressure in a replaceable printhead module which relaxes performance and component specifications on printer ink delivery systems and results in substantial benefits in quality, reliability, size and cost. Embodiments of the dual regulator printhead module enable a cost-effective macro-recirculation system that addresses various factors that contribute to print quality issues in inkjet printing systems such as pigment settling, air and particulate accumulation, and inadequate thermal control within printheads. For example, the macro-recirculation provides a continual refreshing of filtered ink into the module, which refreshes settled ink, reduces air and particulate levels near the printhead, heats ink (e.g., for TIJ printheads) or cools ink (e.g., for PIJ printheads), and generally improves print system reliability. These benefits are achieved in part through an input regulator in the printhead module that finely controls the inlet pressure of ink flowing to the printhead(s) and an output regulator that finely controls the outlet pressure of ink flowing from the printhead(s). A negative pressure differential maintained by the dual regulators between the input and output of the printhead induces a regular ink flow through the printhead. Ink flows from the outlet of the input regulator through ink passages in the die carrier manifold to the back of the printhead substrate, through a gap between the printhead substrate and die carrier, and then returns through ink passages in the manifold to the inlet of the output regulator. The flow path extending behind the printhead substrate can be used to modulate the ink flow rate by choosing an appropriate gap between the printhead substrate and the physical printhead die carrier. In addition, fluidic channels in the printhead itself provide micro-recirculation paths across the top side of the printhead die substrate.

In one example embodiment, a print module includes a printhead die, an input regulator to regulate input fluid pressure to the die, and an output regulator to regulate output fluid pressure from the die. In another embodiment, a method includes receiving fluid at the input regulator to a print module. A fluid pressure differential is created within the print module between the input regulator and an output regulator. The pressure differential induces fluid to flow from the input regulator through a printhead die and to an output regulator. Fluid is then drawn from the output regulator. In another embodiment, a printing system includes a print module having a printhead die, and an input regulator and output regulator to control ink pressure to and from the die. The system also includes an ink supply and a pressure delivery mechanism to deliver ink to the print module. A vacuum pump in the printing system draws ink from the print module, returning it to the ink supply.

Illustrative Embodiments

FIG. 1 shows an inkjet printing system 100 suitable for incorporating a macro-recirculation system and dual regulator printhead module as disclosed herein, according to an embodiment of the disclosure. Inkjet printing system 100 includes printhead module 102, an ink supply 104, a pump 105, a mounting assembly 106, a media transport assembly 108, a printer controller 110, a vacuum pump 111, and at least one power supply 112 that provides power to the various electrical components of inkjet printing system 100. Printhead module 102 generally includes one or more filter and regulation chambers 103 containing one or more filters to filter ink and pressure regulation devices to regulate ink pressure. Printhead module 102 also includes at least one fluid ejection assembly 114 (i.e., a thermal or piezoelectric printhead 114) having a printhead die and associated mechanical and electrical components for ejecting drops of ink through a plurality of orifices or ink nozzles 116 toward print media 118 so as to print onto print media 118. Printhead module 102 also generally includes a carrier that carries the printhead 114, provides electrical communication between the printhead 114 and printer controller 110, and provides fluidic communication between the printhead 114 and ink supply 104 through carrier manifold passages.

Nozzles 116 are usually arranged in one or more columns such that properly sequenced ejection of ink from the nozzles causes characters, symbols, and/or other graphics or images to be printed upon print media 118 as inkjet printhead assembly 102 and print media 118 are moved relative to each other. A typical thermal inkjet (TIJ) printhead includes a nozzle layer arrayed with nozzles 116 and firing resistors formed on an integrated circuit chip/die positioned behind the nozzles. Each printhead 114 is operatively connected to printer controller 110 and ink supply 104. In operation, printer controller 110 selectively energizes the firing resistors to generate heat and vaporize small portions of fluid within firing chambers, forming vapor bubbles that eject drops of ink through nozzles on to the print media 118. In a piezoelectric (PIJ) printhead, a piezoelectric element is used to eject ink from a nozzle. In operation, printer controller 110 selectively energizes the piezoelectric elements located close to the nozzles, causing them to deform very rapidly and eject ink through the nozzles.

Ink supply 104, pump 105, and vacuum pump 111 generally form an ink delivery system (IDS) within printing system 100. The IDS (ink supply 104, pump 105, vacuum pump 111) and the printhead module 102 together, form a larger macro-recirculation system within the printing system 100 that continually circulates ink to and from the printhead module 102 to provide fresh filtered ink to the printheads 114 within the module. Ink flows to printheads 114 from ink supply 104 through chambers 103 in printhead module 102 and back again via vacuum pump 111. During printing, a portion of the ink supplied to printhead module 102 is consumed (i.e., ejected), and a lesser amount of ink is therefore recirculated back to the ink supply 104. In some embodiments, a single pump can be used to both supply and recirculate ink in the IDS. In such embodiments, therefore, a vacuum pump 111 may not be included.

Mounting assembly 106 positions printhead module 102 relative to media transport assembly 108, and media transport assembly 108 positions print media 118 relative to inkjet printhead module 102. Thus, a print zone 122 is defined adjacent to nozzles 116 in an area between printhead module 102 and print media 118. Printing system 100 may include a series of printhead modules 102 that are stationary and that span the width of the print media 118, or one or more modules that scan back and forth across the width of print media 118. In a scanning type printhead assembly, mounting assembly 106 includes a moveable carriage for moving printhead module(s) 102 relative to media transport assembly 108 to scan print media 118. In a stationary or non-scanning type printhead assembly, mounting assembly 106 fixes printhead module(s) 102 at a prescribed position relative to media transport assembly 108. Thus, media transport assembly 108 positions print media 118 relative to printhead module(s) 102.

Printer controller 110 typically includes a processor, firmware, and other printer electronics for communicating with and controlling inkjet printhead module 102, mounting assembly 106, and media transport assembly 108. Electronic controller 110 receives host data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters. Using data 124, printer controller 110 controls inkjet printhead module 102 and printheads 114 to eject ink drops from nozzles 116. Thus, printer controller 110 defines a pattern of ejected ink drops which form characters, symbols, and/or other graphics or images on print media 118. The pattern of ejected ink drops is determined by the print job commands and/or command parameters from data 124.

Figure 2:
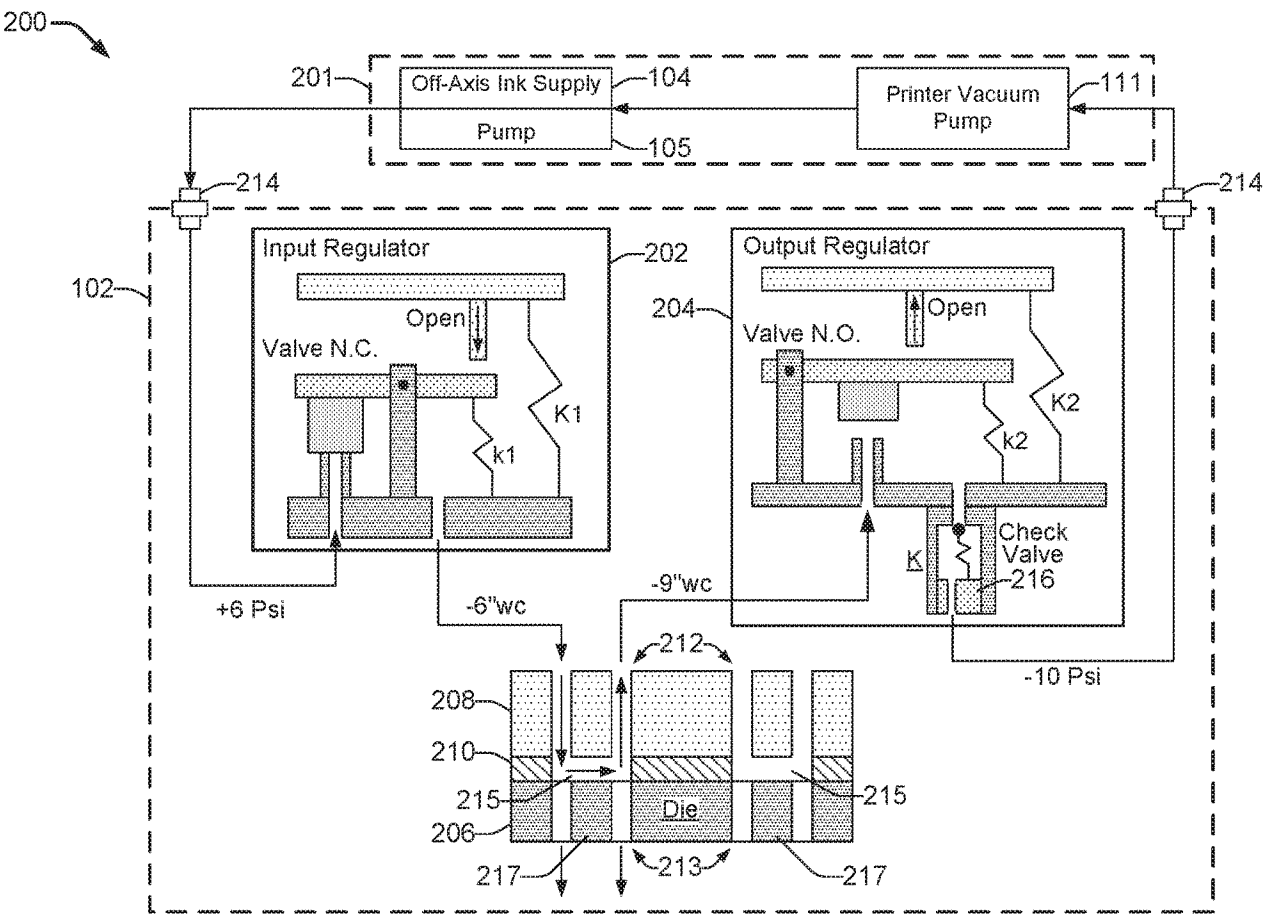
FIG. 2 shows a block diagram of a macro-recirculation system and dual regulator printhead module, according to an embodiment.
Figure 3:
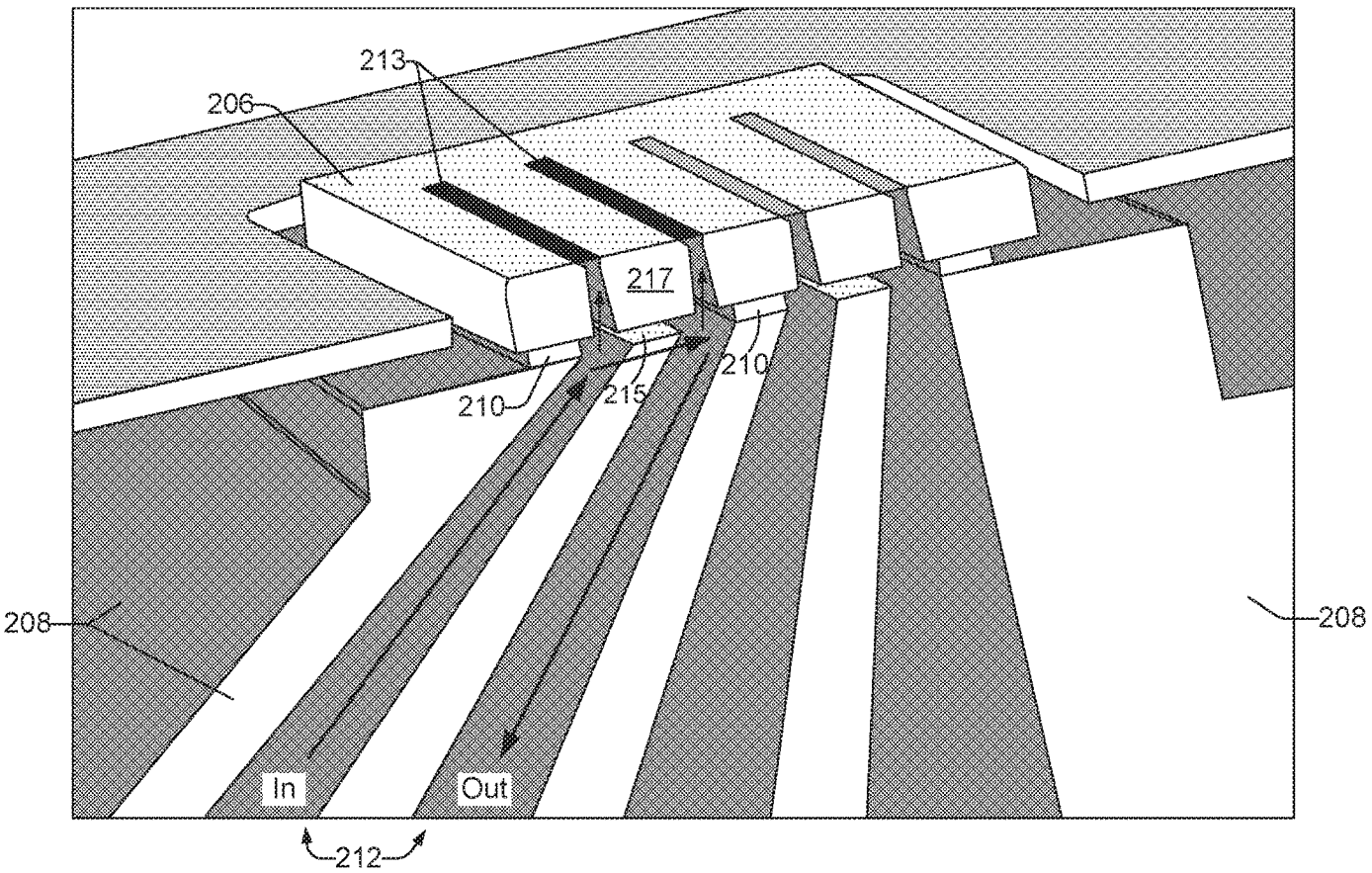
FIG. 3 shows a perspective view of a printhead die and die carrier illustrating a recirculation path in the macro-recirculation system of FIG. 2, according to an embodiment.

FIG. 2 shows a block diagram of a macro-recirculation system 200 and dual regulator printhead module 102 within that system, according to an embodiment of the disclosure. FIG. 3 shows a perspective view of a printhead die and die carrier illustrating the recirculation path in the macro-recirculation system 200 of FIG. 2, according to an embodiment of the disclosure. Referring generally to FIGS. 2 and 3, the macro-recirculation system 200 includes the printing system's IDS 201 (i.e., the ink supply 104, pump 105, and vacuum pump 111) and printhead module 102. Printhead module 102 is a dual pressure regulator module that has an input pressure regulator 202 and an output pressure regulator 204 as shown in FIG. 2. Each regulator 202 and 204 is a pressure-controlled ink containment system. Also shown is a silicon printhead die substrate 206 adhered to a portion of a die carrier 208 with an adhesive 210. The die carrier 208 includes manifold passages 212 through which ink flows to and from the die 206 between regulators 202 and 204. In general, as indicated by the black direction arrows in FIGS. 2 and 3, ink flows from the printer IDS 201 through a fluid interconnect 214 to input regulator 202 of module 102. From regulator 202, ink flows through manifold passages 212 and then through the die 206 into die slots 213 (and out through nozzles 116 during printing; nozzles not shown), and behind the die 206 through gaps 215 which serve as back-of-die bypasses. The gaps 215, as discussed in more detail below, are formed between the die carrier 208 and back of the die 206 where there is no adhesive 210 present to bond selected die ribs (i.e., die ribs 217) to the die carrier 208. Ink then flows out of the die 206 and back through manifold passages 212 to the output regulator 204, after which it flows out of the printhead module 102 and back to the printer IDS 201 through a fluid interconnect 214. For the purpose of illustration and ease of description, the embodiment shown in FIGS. 2 and 3 is a basic implementation of the dual regulator printhead module 102 as it applies to a single ink color and a single fluid pathway leading to and from a single printhead die 206. Thus, while the printhead module 102 shown in FIGS. 2 and 3 includes four fluid slots 213 and additional ink passages (e.g., additional manifold passages 212 and gap 215), these are not specifically described with respect to FIGS. 2 and 3. However, additional example embodiments of macro-recirculation systems 200 having dual regulator printhead modules 102 that vary in complexity and versatility to manage multiple ink colors using one or multiple printhead dies 206 are discussed herein below with respect to FIGS. 4-6.

Referring still to FIGS. 2 and 3, ink backpressure in a printhead die 206 is a fundamental parameter to be maintained within a narrow range below atmospheric levels in order to avoid depriming nozzles (leading to drooling or ink leaking) while optimizing printhead pressure conditions required for inkjet printing. During non-operational periods, this pressure is maintained statically by surface tension of ink in the nozzles. This function can be provided by a standard mechanical regulator such as input regulator 202, which typically operates by using a formed metal spring to apply a force to an area of flexible film attached to the perimeter of a chamber that is open to the atmosphere, thereby establishing a negative internal pressure for ink containment in the integrated printing module. A lever on a pivot point connects the metal spring assembly to a valve such that deflection of the spring can either open or close the valve by mating it to a valve seat. During operation, ink is expelled from the printhead, which evacuates ink from the pressure-controlled ink containment system of the regulator. When the pressure in the regulator reaches the backpressure set point established through design choices for spring force (i.e., spring constants K) and flexible film area, the valve opens and allows ink to be delivered from the pump 105 in the printer IDS 201 (with a typical pressure of positive six pounds per square inch) connected to the inlet of the input regulator 202 through fluidic interconnect 214 of the module 102. Once a sufficient volume of ink is delivered, the spring expands and closes the valve. The regulator operates from fully open to fully closed (i.e., seated) positions. Positions in between the fully open and fully closed positions modulate the pressure drop through the regulator valve itself, causing the valve to act as a flow control element.

In the macro-recirculation system 200 of FIG. 2, the inlet to the valve of input regulator 202 makes a fluidic connection through the fluidic interconnect 214 with the printer IDS 201, and the outlet of the regulator 202 is connected through manifold 208 passages 212 to the printhead die substrate 206. The inlet to the output regulator 204 is connected from the printhead die 206 via return passages 212 in the manifold 208. The input regulator 202 valve is normally closed, while the output regulator 204 is specially configured such that its valve is normally open (i.e., the pivot point for the valve lever is moved to the other side of the valve seat; also, see additional regulator valve discussion below regarding FIG. 7). This allows the output regulator 204 to control pressure in the return portion of the manifold 208 passages 212. The outlet of the output regulator 204 is connected to the printer IDS 201 via a vacuum pump 111 (with a typical pressure of negative ten pounds per square inch). A check valve 216 in the outlet to the output regulator 204 ensures that no back flow can occur, since the regulator valve is in a normally open state. Spring force K for the output regulator 204 is chosen such that the backpressure set point is slightly higher (i.e., more negative) than the backpressure set point for the input regulator 202. This creates pressure-driven flow from the outlet of input regulator 202 to the inlet of output regulator 204. As shown in FIG. 2, a typical value for the input regulator 202 set point is negative six inches of water column; and the typical set point for the output regulator 204 is negative nine inches of water column. Although the description and figures include two pumps (pump 105 and vacuum pump 111), as noted above, it is assumed that the printer IDS 201 can function in a recirculating mode with either one or two pumps. Therefore, in some embodiments a single pump can be used to both supply and recirculate ink in the IDS 201.

During operation, the dual regulators 202 and 204 act to control backpressure behind the printhead die substrate 206 roughly to a range represented by the two set points (i.e., −6 inches water column and −9 inches water column) since there are similar pressure drops through the manifold passages 212 on the inlet and outlet sides. From a non-operating state, the input regulator 202 is closed, the output regulator 204 is open, and the check valve 216 is closed. Thus, no ink flow is present and pressure behind the die 206 is at the set point of the input regulator 202 (i.e., −6 inches water column). When the printer IDS 201 pump 105 is engaged, the pressure drops in the manifold 208 and flow initiates from the input regulator 202. The output regulator 204 valve is drawn closer to the valve seat, and the pressure is regulated in a linear region to the set point (i.e., −9 inches water column). Similarly, on the input regulator 202, pressure is regulated to its set point (i.e., −6 inches water column). Thus, a flow rate is created in the manifold 208 between the two regulators that is proportional to the difference in pressure set points and may be estimated analytically (e.g., using the Hagen-Poiseuille equation) based upon the geometry of the manifold passages 212 together with ink viscosity. Typical values for flow rate with water-based inks can range from below ten to above one thousand milliliters per minute. The design of flow passages including use of flow restrictors can be used to optimize flow rate to system requirements.

When printing starts after a recirculating flow has been established, the printhead 114 (die 206) generates displacement-driven ink flow from the nozzles 116 (i.e., as ink is ejected from ink nozzles 116), which decreases the pressure in the printhead ink slots 213 to below that of the manifold pressure. Adding this printing flow to the control volume represented by the existing inlet/outlet recirculating flow causes the input regulator 202 valve to open more and the output regulator 204 valve to close more, which reduces recirculating ink flow. The system can be designed to accommodate a range of printing flow rate and recirculating flow rate needs. This range can span the case where recirculation is completely stopped during periods of high printing to the other extreme where the recirculating flow is only slightly decreased. The trade-off between ink flow rates of printing and recirculation is proportional to the non-printing recirculation flow rate design point. If the non-printing recirculation flow rate is designed to be substantially below the maximum printing flow rate, recirculating flow will be decreased to the point of shutting off. If the non-printing recirculation flow rate is set substantially above the printing flow rate, flow will be decreased but remain at a relatively high level.

In addition to the design and control of regulators 202 and 204, another factor related to recirculation flow rates is the fluid interaction with the printhead itself, such as the interaction of the ink flowing through the gaps 215 (i.e., the back-of-die bypass). As shown in FIGS. 1 and 2, along a given flow path, the ink flows from one ink slot 213 to another along the backside of die ribs 217 which separate the ink slots 213 of the die 206. The gap 215 dimensions are spatially controlled to optimal specifications both for adhesive joint design (i.e., where adhesive 210 joins the die carrier 208 to the die 206) and for flow control of recirculating ink (i.e., where there is no adhesive 210 between the die carrier 208 and the die 206). Generally, macro-recirculation provides a greater benefit when ink is recirculated closer to the printhead. Typically, a printhead die substrate 206 is manufactured in silicon and includes a number of machined ink slots 213 separated by silicon ribs. A thermally curable adhesive 210 is usually used to attach the ribs to a die carrier 208, which is typically made of a polymer or ceramic material. A variety of adhesive dispense processes, materials, and joint designs are possible and are well-known in the art. For effective macro-recirculation, the adhesive joint between slots is replaced by a gap 215 for ink to flow. Thus, ink flows through a spatially controlled gap 215 along the backside of a die rib 217 that separates two ink slot 213. Other upstream arrangements to create return paths are possible, but using a gap behind the printhead is most effective as it is closest to the settling point for pigments (assuming nozzles eject ink in a direction substantially aligned with acceleration of gravity), and it allows ink to remove heat directly from the printhead die 206 by means of forced convection. If needed for reasons of die fragility, smaller and noncontiguous adhesive joints can also be established along the rib 217 (such as at the midpoint) without significantly affecting ink flow.

Figure 4:
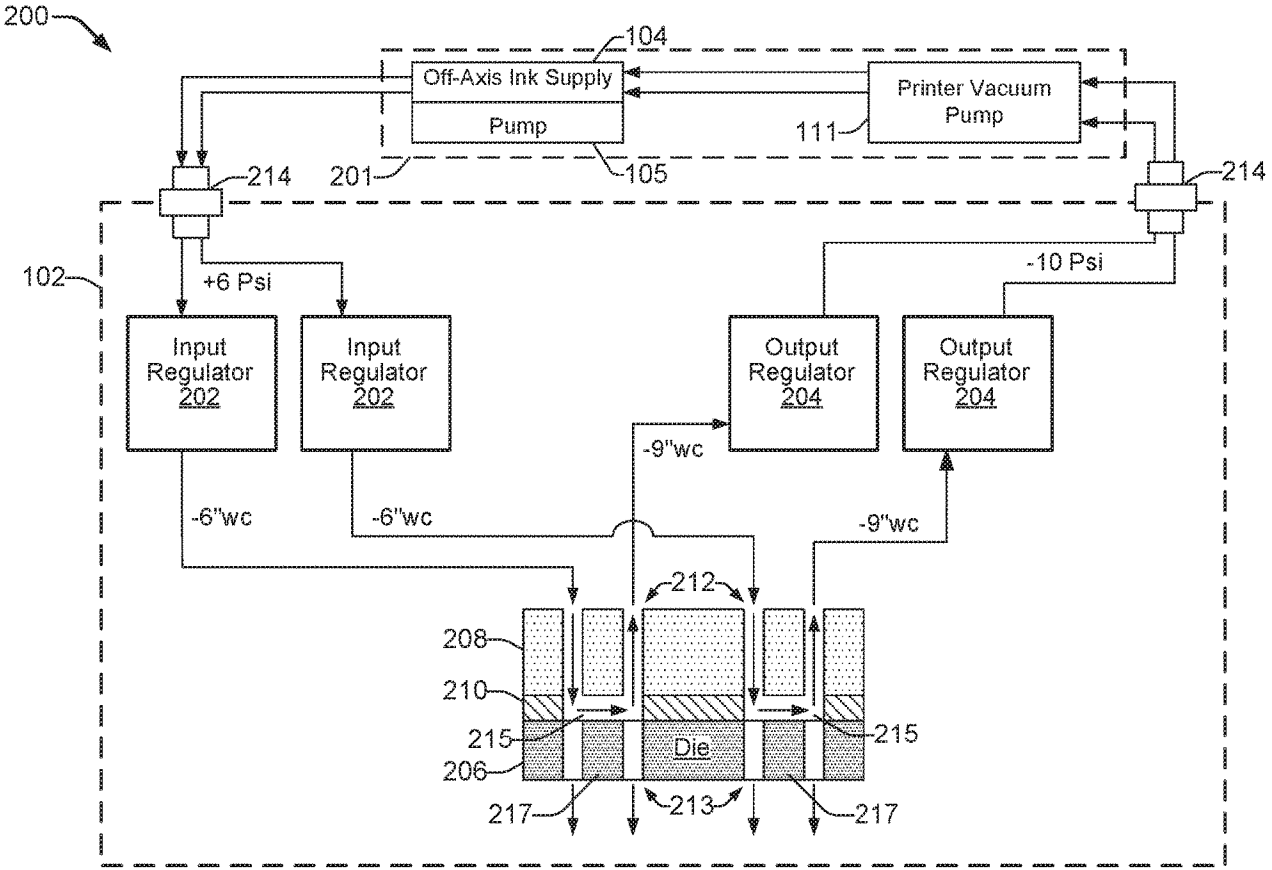
FIG. 4 shows a block diagram of a macro-recirculation system having a printhead module with a single printhead die and two sets of dual pressure regulators, according to an embodiment.
Figure 5:
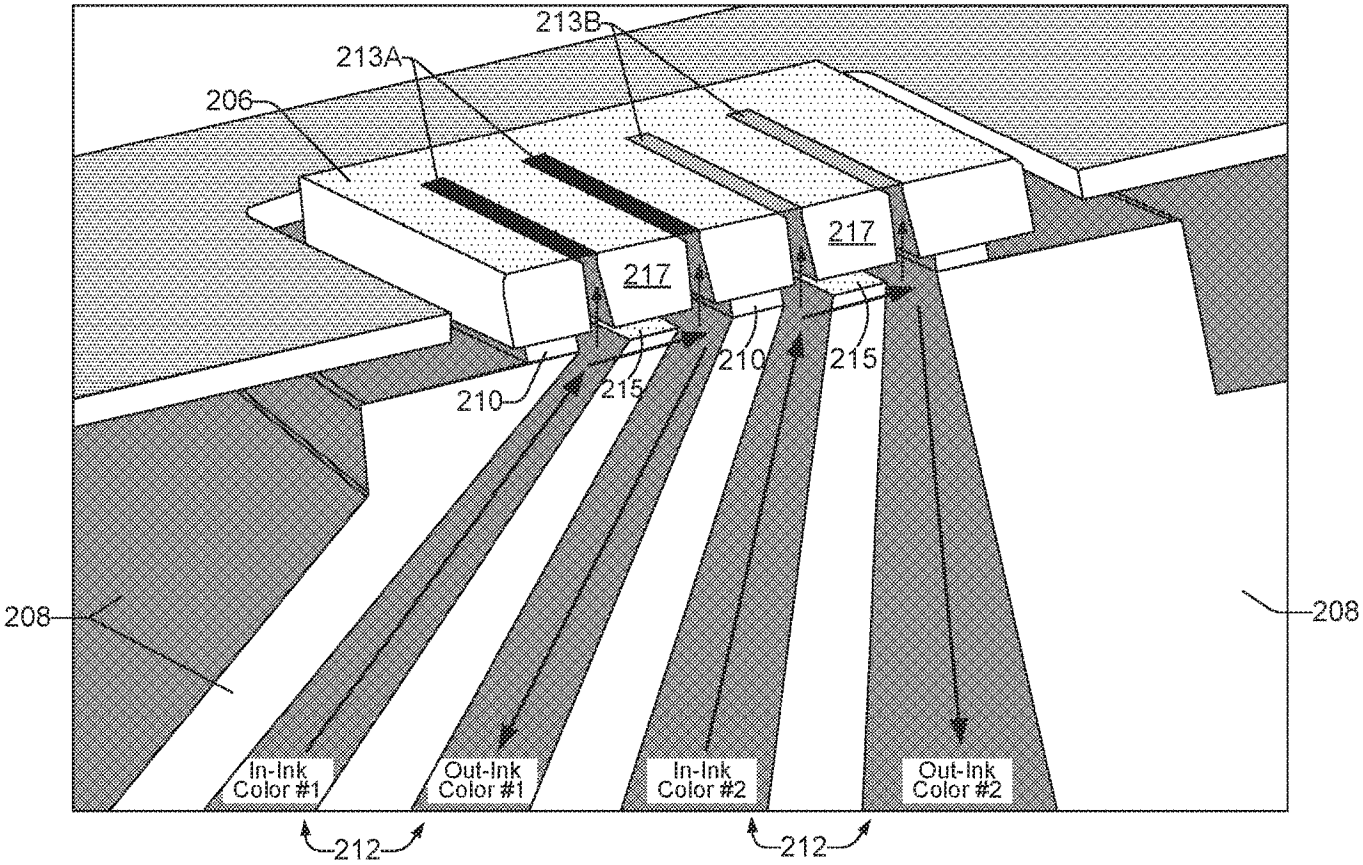
FIG. 5 shows a perspective view of the printhead die and die carrier illustrating recirculation paths for two ink colors in the macro-recirculation system of FIG. 4, according to an embodiment.

As noted above, embodiments of a macro-recirculation system 200 having a dual regulator printhead module 102 can vary in complexity and versatility to manage multiple ink colors using one or multiple printhead dies 206. FIG. 4 shows a block diagram of a macro-recirculation system 200 having a printhead module 102 with a single printhead die 206 and two sets of dual pressure regulators to control two ink colors, according to an embodiment of the disclosure. FIG. 5 shows a perspective view of the printhead die 206 and die carrier 208 illustrating recirculation paths for two ink colors in the macro-recirculation system 200 of FIG. 4, according to an embodiment of the disclosure. Referring to FIGS. 4 and 5, the two-color macro-recirculation system 200 with the single die 206 operates in the same general manner as described above regarding the single-color system shown in FIGS. 2 and 3. That is, each ink color follows a single fluid path controlled by a set of dual pressure regulators (i.e., an input regulator 202 and output regulator 204). Thus, as indicated by the black direction arrows in FIGS. 4 and 5, the ink supply 104 in the printer IDS 201 provides two ink colors to the printhead module 102 through a fluid interconnect 214. Each ink color flows through separate input regulators 202 and manifold passages 212 to the die 206, and then into different pairs of die slots 213A and 213B and out through nozzles 116 (not shown) during printing. The two ink colors flow through respective gaps 215 behind the die 206, and then out of the die 206 and back through separate return manifold passages 212 to separate output regulators 204, after which they flow out of the printhead module 102 and back to the printer IDS 201 through a fluid interconnect 214.

Figure 6:
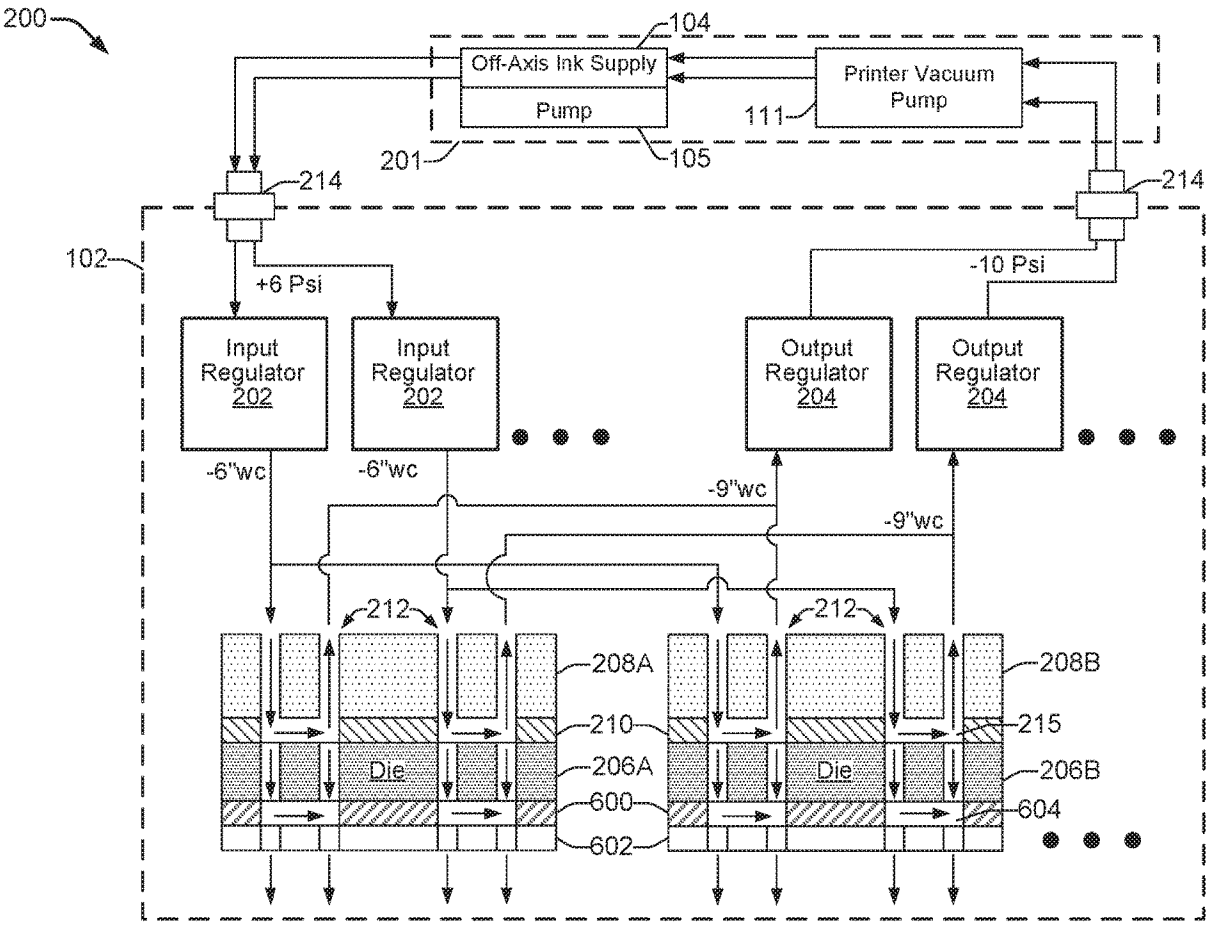
FIG. 6 shows a block diagram of a macro-recirculation system having a printhead module with multiple printhead dies and multiple sets of dual pressure regulators, according to an embodiment.

FIG. 6 shows a block diagram of a macro-recirculation system 200 having a printhead module 102 with multiple printhead dies 206 (two dies 206 are specifically shown) and multiple sets of dual pressure regulators (two dual regulator sets are specifically shown) to control two ink colors, according to an embodiment of the disclosure. In viewing the embodiments illustrated in FIGS. 4-6, several points are worth noting. One point to note is that a printhead module 102 includes a separate set of dual pressure regulators (i.e., an input regulator 202 and output regulator 204) for each ink color it controls. Therefore, a module 102 controlling two ink colors will have two sets of dual regulators, a module 102 controlling three ink colors will have three sets of dual regulators, and so on. Furthermore, although a single set of dual regulators controls only a single ink color, a single set of dual regulators can control the flow of the single ink color through a single fluid path to and from one printhead die 206, or through multiple fluid paths to and from multiple printhead dies 206 in parallel. For example, referring to FIG. 6, each ink color follows multiple fluid paths controlled by a set of dual pressure regulators (i.e., an input regulator 202 and output regulator 204). Thus, as indicated by the black direction arrows in FIG. 6, the ink supply 104 in the printer IDS 201 provides two ink colors to the printhead module 102 through a fluid interconnect 214. Each ink color flows through separate input regulators 202. From the input regulators 202, however, each ink color then flows through passages 212 in different manifolds 208 (e.g., 208A, 208B) to each of the multiple dies 206 (e.g., 206A, 206B). Although only two dies 206 are shown in FIG. 6, different embodiments of printhead module 102 can include additional dies 206, such as six, eight, ten, or more dies 206. Thus, in different embodiments, input regulators 202 can manage the flow of a single ink color through numerous fluid paths to numerous printhead dies 206. Each ink color then flows into different pairs of die slots within the multiple dies 206, and out through nozzles 116 (not shown) during printing. The two ink colors flow through respective gaps 215 behind the multiple dies 206, and then back through separate return manifold passages 212 to separate output regulators 204, after which they flow out of the printhead module 102 and back to the printer IDS 201 through a fluid interconnect 214.

In addition to the multiple dies 206 and fluid paths as just described, the embodiment in FIG. 6 also illustrates micro-circulation through the printhead itself. Shown in FIG. 6 are a chamber layer 600 and nozzle layer 602. As is generally known regarding inkjet printheads, a chamber layer 600 has ink chambers that store small amounts of ink just prior to ejection of the ink from the chambers through nozzles formed in the nozzle layer 602. In addition to the macro-recirculation through gaps 215, in some embodiments micro-recirculation of ink within the printhead is also implemented. For micro-recirculation, micro-channels 604 are formed in the chamber layer 600 between chambers (adjacent to nozzles) and fluid slots. In general, use of the gaps 215 behind the silicon die 206 in the macro-recirculation system enhances through-printhead micro-recirculation by providing a high-impedance pressure source at the inlet and outlet slots. Typical flow rates enabled by macro-recirculation can be much higher than is typically needed for management of micro-air or control of decap modes such as plugging (due to solvent evaporation) or pigment ink vehicle separation (PIVS). Additionally, drooling from the nozzles can limit rates of recirculation to very low levels. Therefore, using gaps 215 behind the printhead die 206 to optimize flow control for micro-recirculation further enhances flow and allows a greater degree of freedom for macro-recirculation design in terms of optimization to other system needs such as pigment settling and thermal control.

Figure 7:
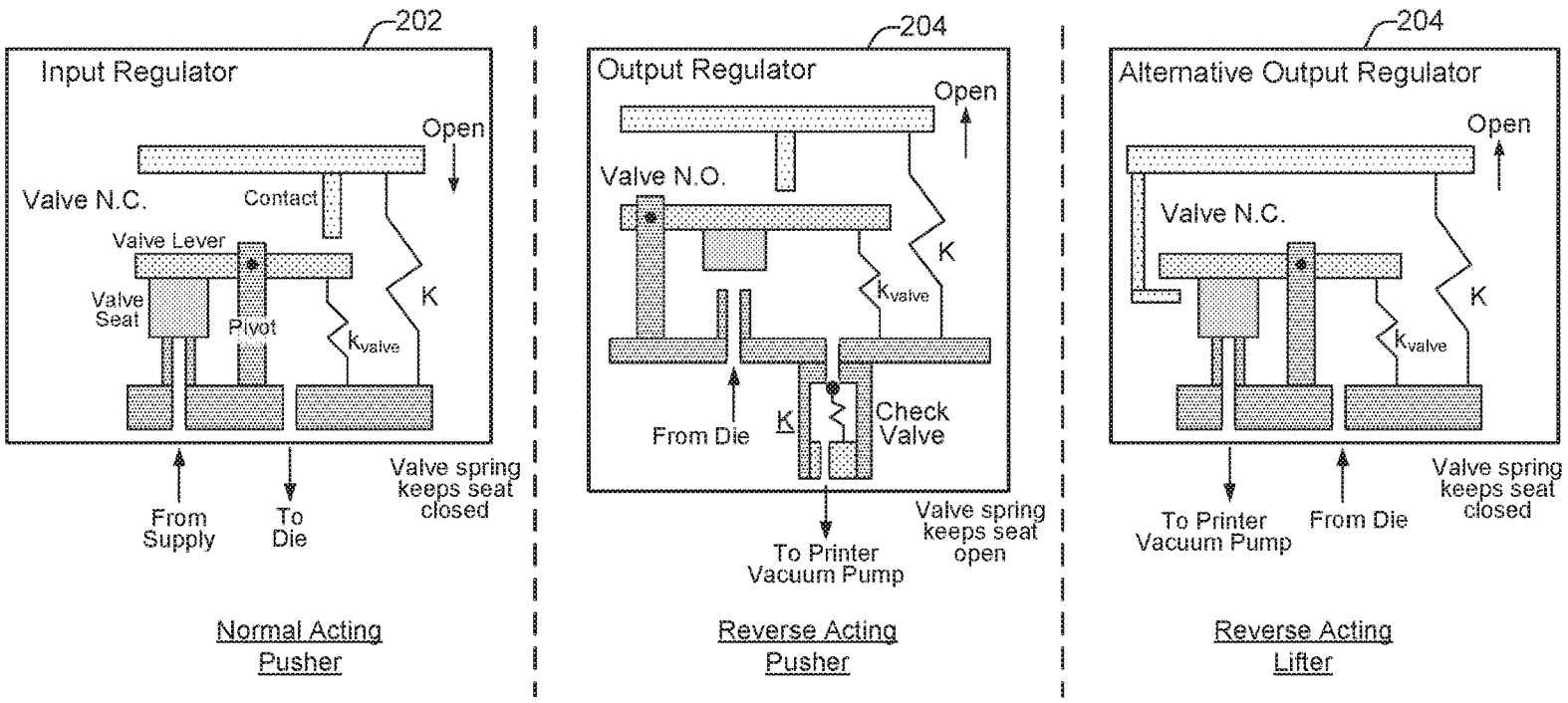
FIG. 7 shows an alternative design of an output pressure regulator for a macro-recirculation system having a dual regulator printhead module, according to an embodiment.

FIG. 7 shows an alternative design of an output pressure regulator 204 for a macro-recirculation system 200 having a dual regulator printhead module 102, according to an embodiment of the disclosure. The input regulator 202 may be classified as a "normal acting pusher" that is normally closed. The output regulator 204 previously discussed with respect to FIGS. 2-6 may be described as a "reverse acting pusher" since the pivot point on the valve lever has been moved to the other side of the valve such that it is normally open, but the spring still pushes on the valve lever. The "reverse acting pusher" design requires a check valve on the outlet to the printer pump. An alternative to the "reverse acting pusher" can be termed a "reverse acting lifter" that lifts rather than pushes on the valve lever. The contact point in this case is moved to the other side of the valve seat such that the valve is lifted open rather than pushed closed. In this case, the pivot point for the lever is not required to change, and no check valve is required. However, there is an increased difficulty implementing this type of design because it changes the interaction among regulator components compared to the standard input regulator 202.

In some regulator embodiments, an enhanced pressure control scheme can be implemented by the introduction of gas pressure as a control parameter outside the regulator chambers. In the description above, the assumption has been that the pressure outside the regulator chambers is ambient atmospheric pressure. However, the external regulator cavity can be pressurized to provide a purge function known as priming. Chamber pressure can be used to control the valve position of both input and output regulators, 202 and 204. For example, with the printer pump 105 on the outlet side of the output regulator 204 turned off, the input regulator 202 chamber can be pressurized to open the valve, which allows a priming function by forcing ink through the nozzles. In another example, with the printer pump 105 off, the pressure on the chambers for both the input and output regulators can be modulated such that ink is pumped from one regulator to the other in alternating directions to provide a degree of mixing in the manifold 208 that may be beneficial for pigment settling. In a third example, one or both regulators can be bypassed by pressurizing or evacuating the regulator chambers to completely open the valves. For the input regulator 202, a high positive pressure is applied, and for the output regulator 204, a high negative (near vacuum) pressure is applied. These pressure applications disengage the onboard print module 102 regulation functions and require the printer IDS 201 to perform the precise functions of pressure regulation, which is generally more difficult, but in some situations may be advantageous.

Figure 8:
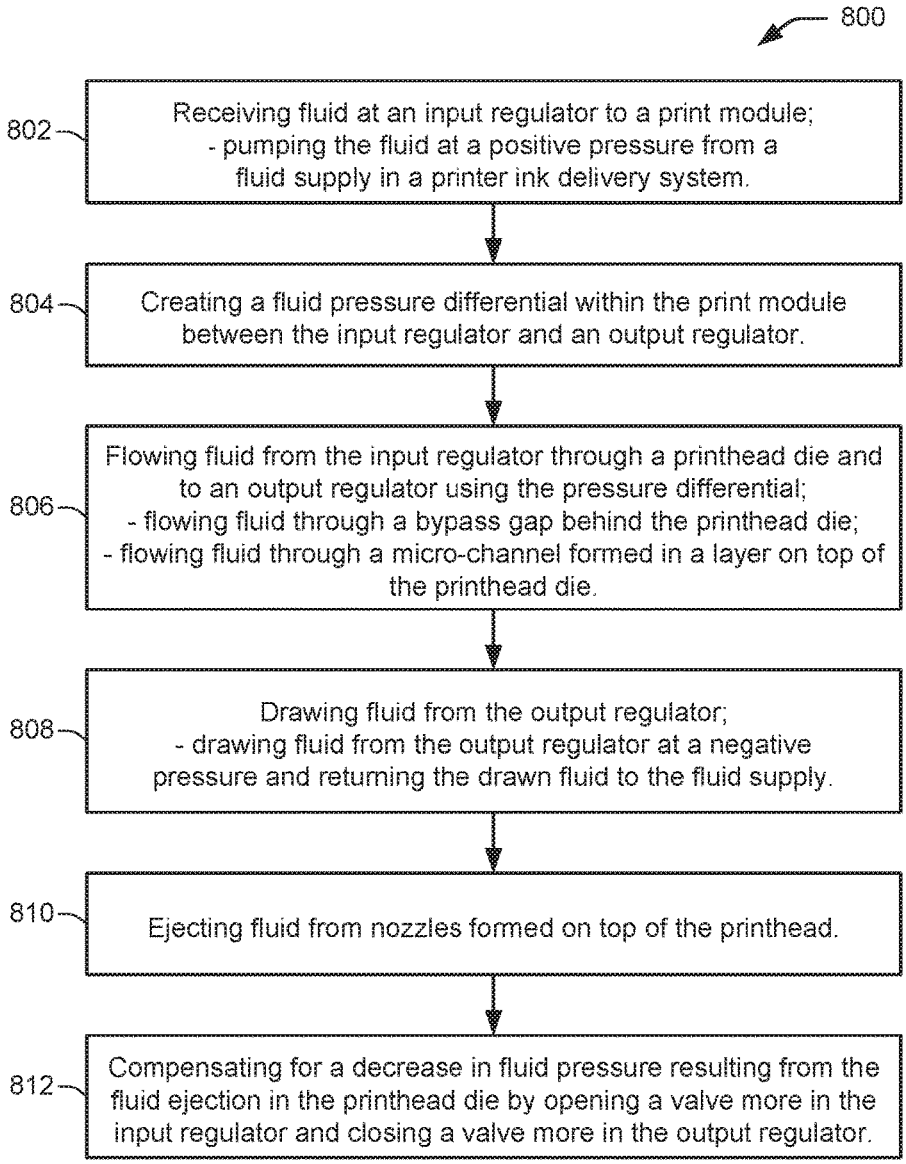
FIG. 8 shows a flowchart of an example method of recirculating fluid in an inkjet printing system, according to an embodiment.

FIG. 8 shows a flowchart of an example method 800 of recirculating fluid in an inkjet printing system, according to an embodiment of the disclosure. Method 800 is associated with the embodiments of a macro-recirculation system 200 and dual regulator printhead module 102 discussed above with respect to illustrations in FIGS. 1-7.

Method 800 begins at block 802 with receiving fluid at an input pressure regulator to a print module. The fluid (e.g., ink) is pumped at a positive pressure from an ink supply in a printer ink delivery system by a pump to the input regulator in the print module. The method 800 continues at block 804 with creating a fluid pressure differential within the print module between the input regulator and an output regulator. The input regulator has a negative backpressure setpoint (e.g., around negative six inches of water column) that is higher than a negative backpressure setpoint in the output regulator (e.g., around negative nine inches of water column) fluid pressure differential. The pressure differential is the difference between the two negative backpressure setpoints of the input and output regulators.

The method 800 continues at block 806 with flowing fluid from the input regulator through a printhead die and to an output regulator using the pressure differential. The pressure differential creates a pressure-driven flow which flows fluid from the outlet of input regulator to the inlet of output regulator. The flow of fluid from the input regulator to the output regulator can follow fluid paths including a bypass gap behind the printhead die and a micro-channel formed in a layer on top of the printhead die. At block 808 of method 800, fluid is drawn from the output regulator at a negative pressure and returned to the fluid supply in the printer IDS.

At block 810 of method 800, fluid is ejected from nozzles formed in a nozzle layer on top of the printhead die. The ejection of fluid creates a negative pressure in the printhead die, which at block 812 is compensated for by opening a valve more in the input regulator and closing a valve more in the output regulator.

What is claimed is:

1. A method comprising:

receiving fluid at an input regulator to a print module;

creating a fluid pressure differential within the prim module between the input regulator and an output regulator;

flowing fluid from the input regulator through a printhead die and to the output regulator using the pressure differential, the flowing through the printhead die comprising flowing fluid through fluid paths selected from the group consisting of a bypass gap behind the printhead die and a micro-channel formed in a layer on top of the printhead die; and drawing fluid from the output regulator.

2. The method of claim 1, wherein receiving fluid comprises pumping the fluid from a fluid supply at a positive pressure.

3. The method of claim 2, wherein drawing fluid comprises drawing fluid from the output regulator at a negative pressure and returning the drawn fluid to the fluid supply.

4. The method of claim 1, further comprising:

ejecting fluid from nozzles formed on top of the printhead die; and compensating for a resulting decrease in fluid pressure in the printhead die by opening a valve more in the input regulator and closing a valve more in the output regulator.

5. A method comprising:

receiving fluid at an input regulator to a print module;

creating a fluid pressure differential within the print module between the input regulator and an output regulator;

flowing fluid from the input regulator through a printhead die and to the output regulator using the pressure differential; and drawing fluid from the output regulator, wherein both the input and output regulators comprise a mechanical system responsive to pressure so as to actuate a valve.

6. The method of claim 5, wherein receiving fluid comprises pumping the fluid from a fluid supply at a positive pressure.

7. The method of claim 6, wherein drawing fluid comprises drawing fluid from the output regulator at a negative pressure and returning the drawn fluid to the fluid supply.

8. The method of claim 5, further comprising:

ejecting fluid from nozzles formed on top of the printhead die; and compensating for a resulting decrease in fluid pressure in the printhead die by opening a valve more in the input regulator and closing a valve more in the output regulator.

9. The method of claim 5, wherein flowing fluid comprises flowing fluid through fluid paths selected from the group consisting of a bypass gap behind the printhead die and a micro-channel formed in a layer on top of the printhead die.

10. The method of claim 5, wherein, in each of the input and output regulators, the mechanical system comprises a flexible film biased by a spring, a spring constant of the spring determining a set point at which pressure on the flexible film will actuate the valve of that regulator.

11. The method of claim 10, wherein a valve of the input regulator is biased normally-closed by an input valve spring, the input valve spring configured to allow actuation of the normally-closed valve by the flexible film of the input regulator.

12. The method of claim 10, wherein the valve of the output regulator is biased normally-open by an output valve spring, the output valve second spring configured to allow actuation of the normally-open valve by the flexible film of the output regulator.

13. A method comprising:

with a pressure delivery mechanism, delivering ink to a print module;

with a printhead die of the print module, selectively depositing ink to form an image; and, with an input regulator and output regulator, controlling ink pressure to and from the die, wherein the output regulator comprises a normally-open valve configured to close when pressure falls below a set point pressure to maintain a backpressure in the print module.

14. The method of claim 13, further comprising, with a vacuum pump, drawing draw ink from the print module.

15. The method of claim 13, wherein both the input and output regulators comprise a mechanical system responsive to pressure so as to actuate a valve.

16. The method of claim 13, further comprising pumping the ink to the input regulator from an ink supply at a positive pressure.

17. The method of claim 16, further comprising drawing ink from the output regulator at a negative pressure and returning the drawn ink to the ink supply.

18. The method of claim 13, further comprising:

ejecting ink from nozzles formed on the printhead die; and compensating for a resulting decrease in fluid pressure in the printhead die by opening a valve more in the input regulator and closing a valve more in the output regulator.

19. The method of claim 13, further comprising flowing fluid through fluid paths selected from the group consisting of a bypass gap behind the printhead die and a micro-channel formed in a layer on top of the printhead die.

* * * * *